US006543928B2

(12) United States Patent
Beebe

(10) Patent No.: US 6,543,928 B2
(45) Date of Patent: Apr. 8, 2003

(54) PROCESSING VESSEL AND METHOD FOR MIXING POWDERS WITH A MAGNETICALLY COUPLED AGITATOR

(75) Inventor: Clark A. Beebe, Springfield, NJ (US)

(73) Assignee: General Machine Company of New Jersey, Inc., Middlesex, NJ (US)

( * ) Notice: Subject to any disclaimer, the term of this patent is extended or adjusted under 35 U.S.C. 154(b) by 91 days.

(21) Appl. No.: 09/849,374

(22) Filed: May 4, 2001

(65) Prior Publication Data

US 2002/0163855 A1 Nov. 7, 2002

(51) Int. Cl.[7] ..... B01F 9/08; B01F 13/08

(52) U.S. Cl. ..... 366/144; 366/224; 366/273

(58) Field of Search ..... 366/56, 94, 95, 366/144–147, 192, 193, 222–224, 273, 274; 422/209, 210, 271, 226

(56) References Cited

U.S. PATENT DOCUMENTS

| | | | | |
|---|---|---|---|---|
| 2,018,082 A | * | 10/1935 | Muench et al. | |
| 2,108,502 A | * | 2/1938 | Muench | |
| 2,495,895 A | | 1/1950 | Hervert | |
| 2,556,854 A | | 6/1951 | Spears et al. | |
| 2,711,306 A | | 6/1955 | Levi | |
| 2,996,363 A | | 8/1961 | Ruyak | |
| 3,590,776 A | * | 7/1971 | Tudor et al. | |
| 4,013,384 A | | 3/1977 | Oikawa | 417/368 |
| 4,183,678 A | * | 1/1980 | Ohno | |
| 4,207,485 A | | 6/1980 | Silver | 310/104 |
| 4,209,259 A | * | 6/1980 | Rains et al. | |
| 4,247,792 A | | 1/1981 | Klicks et al. | 310/104 |
| 4,277,707 A | | 7/1981 | Silver et al. | 310/104 |
| 4,390,283 A | * | 6/1983 | Meyer | |
| 4,483,623 A | | 11/1984 | Eaton et al. | 366/247 |
| 4,534,656 A | | 8/1985 | de Bruyne | 366/247 |
| 4,698,917 A | * | 10/1987 | Debolini | |
| 4,993,841 A | * | 2/1991 | Lofgren et al. | |
| 5,292,284 A | | 3/1994 | Denk et al. | 464/29 |
| 5,407,272 A | | 4/1995 | Meier | 366/274 |
| 5,470,152 A | | 11/1995 | Rains | 366/273 |
| 5,533,803 A | | 7/1996 | Meier | 366/273 |
| 6,065,865 A | | 5/2000 | Eyraud et al. | 366/273 |
| 6,206,562 B1 | * | 3/2001 | Eyraud et al. | |

FOREIGN PATENT DOCUMENTS

| | | | |
|---|---|---|---|
| EP | 0 399 971 A1 | * | 5/1990 |
| JP | 03-127618 A | * | 5/1991 |

* cited by examiner

*Primary Examiner*—Charles E. Cooley
*Assistant Examiner*—David Sorkin
(74) *Attorney, Agent, or Firm*—Norris, McLaughlin & Marcus

(57) ABSTRACT

A rotating processing vessel and a method of using a magnetically coupled agitator which does not penetrate the vessel walls to mix dry or moist powders within the rotating processing vessel.

5 Claims, 5 Drawing Sheets

PROCESSING VESSEL AND METHOD FOR MIXING POWDERS WITH A MAGNETICALLY COUPLED AGITATOR

BACKGROUND OF THE INVENTION

1. Field of the Invention

The present invention relates generally to a processing vessel and a method of mixing powders with a magnetically coupled agitator mounted inside of the processing vessel. More particularly the invention is directed toward a rotating processing vessel and a method of using a magnetically coupled agitator to mix dry or moist powders inside of the rotating powder processing vessel. Although the method of the present invention has many different applications, it is described herein primarily as used for mixing dry powders inside of a tumble blender.

2. Description of the Related Art

Rotating tumble blenders are frequently used to mix dry chemical compounds and other ingredients for the pharmaceutical, food, cosmetic and other industries. Because of the nature of these highly-regulated industries, a sterile mixing environment or an environment which is free from cross-contamination is oftentimes required during the mixing process. Besides operating under ambient pressure conditions, for some applications, the blender operates under pressures greater than atmospheric. For other applications, the blender operates under less than atmospheric pressure. To satisfy all of these applications, tumble blenders must be constructed and operated to both prevent contaminants from entering the vessel, such as when the vessel is operating at less than atmospheric pressure during a mixing process, as well as prevent the vessel's contents from escaping to the environment outside the vessel walls such as when the vessel is operated under conditions greater than atmospheric pressure.

In some applications a tumble blender is outfitted with a rotating agitator designed to enhance and/or accelerate the mixing of the contents of the blender. In these instances the tumble blender typically includes a drive shaft that couples a mixing agitator (impeller) located within the interior of the vessel to a motor located outside of the blender vessel. To effect such an arrangement where the drive shaft penetrates the vessel wall, the vessel oftentimes contains mechanical seals and/or a packing arrangement located between the drive shaft and the vessel wall. These seals and packing are designed to prevent the vessel contents from migrating along the drive shaft into the bearings and ultimately out of the vessel particularly when the interior of the vessel is operating under greater than ambient pressure conditions. Additionally, the seals and packing prevent any outside contaminants from entering the vessel along the same route particularly when the interior of the vessel is operating under negative pressure conditions (less than atmospheric pressure). Such seals and packing arrangements are undesirable for the mixing applications referenced above because they are susceptible to failure, especially under pressurized or negative pressure conditions. Additionally, such seals, packing and bearing failures when the powders migrate past the seals add to the blender's maintenance costs because they are difficult to clean and replace. Cleaning and replacement is required to prevent product which becomes entrained in the seals and packing during one mixing application from cross-contaminating a second, different, product during a subsequent mixing application within the same vessel.

In a typical dry mixing application, when an agitator rotates inside of the mixing vessel, work energy is added to the dry powders situated therein, creating heat. In some instances the heat energy increases the temperature of the air inside of the vessel causing a buildup of pressure. If there is no mechanism, such as an atmospheric vent or pressure relief valve, to allow the pressure to dissipate from within the vessel to the surrounding atmosphere, internal pressure within the vessel forces the powders back along the agitator shaft inside of the vessel. This causes the bearings, mechanical seals and/or packings to fail prematurely resulting in the escape of powders from the vessel to the outside environment.

In those instances where the vessel is vented to the atmosphere to alleviate any pressure build-up, filters or filter cloths are typically placed over the vents in an attempt to prevent the powders inside of the vessel from escaping. Inevitably, however, some powders do pass through these filter arrangements thus creating an environment detrimental to worker health and safety particularly where the powders are toxic or reactive. Furthermore, after a period of use the filters often become blinded by the powder. This blinding effectively seals the vent and allows pressure to build-up within the vessel. This increased pressure causes the mechanical seals and/or packings to fail prematurely. The use of pressure relief valves in these applications presents similar difficulties as they too often become clogged by the powder.

To eliminate these problems when mixing dry or moist powders in a rotating tumble blender, the processing vessel and method of the present invention uses a magnetic coupler to couple the mixing agitator on the interior of the blender to a motor located outside of the blending vessel. The magnetic coupler comprises on the outside of the vessel walls a magnet (the "drive" magnet) attached to a shaft which is rotated by a motor and, on the interior of the vessel, another magnet (the "driven" magnet) connected to the agitator. In this manner the drive shaft does not penetrate the vessel walls and the need for seals and/or packing in the vessel walls is eliminated. The drive and driven magnets are assembled close together, although they are on opposite sides of the blender vessel wall, so that the rotation of the drive magnet rotates the driven magnet and hence the agitator. This magnetic coupling arrangement advantageously allows the mixing agitator inside the blender to be rotated by a motor outside of the blender without mechanically connecting the two members. Therefore, in the processing vessel and method of the present invention, pressurized or negative pressure conditions inside of the mixing vessel no longer present a problem for maintaining a sterile mixing environment since the drive shaft does not penetrate the vessel's walls. Since the mechanical seals and/or packing associated with a traditional agitator application are eliminated, a conduit for cross-contamination between the interior and exterior of the vessel along the drive shaft is eliminated. Additionally, the need for an atmospheric vent and any associated filter or filter cloth is also eliminated.

Magnetic couplings in general are well known in the prior art for mixing or pumping liquids. Typically, such magnetic couplings comprise a pair of axially or radially opposed magnets, or sets of magnets, formed from a magnetic material. One of the magnets is coupled to a driving member such as a shaft from a motor, and the other magnet is coupled to a driven member such as a pump impeller or agitator. The magnets are magnetically coupled to each other so that rotation of the driving member causes a corresponding rotation of the driven member to obtain the desired torque output. Couplings of this type are particularly advantageous, as described above, when it is desirable for an impermeable barrier to be interposed between the driving and driven members such as in stirred reactors, autoclaves, centrifugal pumps and the like. In such applications, the barrier assures against passage or leakage of any process fluid being mixed between the driving and driven members, and thereby prolongs the operating life of the equipment. For examples of prior art mixers, stirrers and pumps employing magnetic couplings in liquid applications see U.S. Pat. Nos. 2,495,895; 2,556,854; 2,711,306; 2,996,393; 4,207,485; 4,247,792; 4,277,707; 4,534,656; 5,292,284; 5,407,272; 5,470,152 and 5,533,803.

During operation, a magnetic coupling may generate substantial quantities of heat due to relative slippage of the magnets at excessive torque loads, induction heating effects, and the like. This is particularly true with closely aligned, radially intermitting permanent magnets. In such instances the wall between the driving and driven magnets in liquid mixing applications is typically cooled by exposing the wall to the process liquid being pumped or mixed, or by exposing the wall to a coolant such as a cooling oil bath.

The application of a magnetically coupled agitator to mix dry or moist powders inside of a processing vessel is heretofore unknown in the prior art. More particularly, a method of using a magnetically coupled agitator to mix dry or moist powders inside of a rotating powder processing vessel operating under greater than or less than atmospheric pressure is heretofore unknown in the prior art.

SUMMARY OF THE INVENTION

In accordance with the method and device of the present invention, a magnetically coupled agitator is used for mixing dry or moist powders inside of a rotating tumble blender or other processing vessel. The vessel can be operated under a pressure greater than, equal to, or less than atmospheric pressure. The present invention eliminates the need for lip seals, mechanical seals and/or packing in the vessel walls, such as are used with agitators in the method of mixing powders in the prior art. Thus, in the present invention a conduit for cross-contamination between the powders being mixed and the environment outside of the mixing vessel is eliminated as is the possibility of cross-contamination between batches of different, sequentially mixed powders due to the entrainment of powders in the mechanical seals and/or packing. The present invention further eliminates the need for venting the processing vessel to the atmosphere during operation, thus limiting the likelihood of powders escaping from the processing vessel and reducing the threat to worker health or safety particularly where the powders being mixed are toxic or reactive.

Thus, it is one of the objects of the present invention to provide a processing vessel for mixing dry or moist powders which rotates about its axis and which comprises a rotating, magnetically coupled agitator.

It is a further object of the present invention to provide a new method for the batch or continuous mixing of dry or moist powders inside of a vessel which rotates about its axis and comprises a rotating, magnetically coupled agitator.

It is a further object of the present invention to provide a new method for the batch or continuous mixing of dry or moist powders inside of a rotating vessel which comprises a rotating, magnetically coupled agitator, which can operate under a pressure greater than or less than atmospheric and which avoids the problem of cross-contamination normally encountered where agitator driving mechanisms must enter through walls of a mixing vessel.

It is a further object of the present invention to provide a rotating processing vessel for mixing dry or moist powders which comprises a rotating, magnetically coupled agitator, which operates under a pressure greater than or less than atmospheric and which avoids the problem of cross-contamination normally encountered where agitator driving mechanisms must enter through walls of the processing vessel.

It is a still further object of the present invention to provide a method for mixing dry or moist powders inside of a pressurized vessel which comprises a rotating, magnetically coupled agitator, and which reduces the threat to worker health and safety.

It is yet a still further object of the present invention to provide a processing vessel for mixing dry or moist powders which rotates about its axis, which comprises a magnetically coupled agitator and which reduces the threat to worker health and safety.

In accordance with the foregoing objects, a rotating processing vessel for mixing dry or moist powders which comprises a rotating, magnetically coupled agitator is disclosed.

In further accordance with the foregoing objects, a method of using a magnetically coupled agitator to mix dry or moist powders inside of a rotating powder processing vessel is disclosed.

Briefly, the above and further objects are realized in accordance with the present invention by providing a substantially airtight processing or mixing vessel. Such a vessel is constructed to withstand operating pressures both in excess of and less than atmospheric pressure and, in some instances, may be a vessel constructed in accordance with the American Society of Mechanical Engineers ("ASME") Boiler and Pressure Vessel Code. The vessel shell may be of single or multiple-walled construction and is made of a substantially non-magnetic material such as a substantially non-magnetic metal, alloy (such as stainless steel or Hastelloy®), plastic or other material. Vessel dimensions will vary from application to application but generally range from about one (1) foot in diameter and about one and one-half (1½) feet in height to about ten (10) feet in diameter and about fifteen (15) feet in height.

The vessel is comprised of a shell, a substantially airtight cover, a substantially airtight main valve, a magnetically coupled agitator, a means for rotating the vessel about its axis and a means for rotating the agitator. The axis about which the vessel is rotated is preferably 30 degrees from the horizontal, more preferably 15 degrees from horizontal, and most preferably the vessel is rotated about its substantially horizontal axis. The vessel may also comprise a pressure relief valve. The cover is located in the top wall of the vessel and is either completely removable from the vessel or is hinged thereto.

To begin a batch mixing process either the main valve or the cover is opened. Both the main valve and the cover are sufficiently sized to permit ready entry into the vessel of the powder or powders to be mixed. Such powders are non-magnetic and have a moisture content of from about zero to about 50%. The following describes the batch mixing process where the cover has been chosen by the operator to be opened. After opening the cover the opened vessel is filled with powder to a predetermined level depending upon the particular mixing application. Some amount of freeboard is maintained between the top surface of the loaded powder and the top wall or the cover of the mixing vessel. This freeboard space permits the powder to move freely and expand during the tumble mixing and agitating process. Upon filling the vessel to the desired level with the powder to be mixed, the cover is closed and sealed so that the processing vessel is substantially airtight. The main valve is located in the bottom wall of the vessel and remains closed and substantially airtight during the powder loading operation.

The processing vessel being employed for the particular mixing application, such as a tumble blender, tumble dryer or other vessel suitable for mixing powders, is then rotated (tumbled) around its axis by means of a motor or other power source located externally from the vessel. The vessel is rotated in this manner at a speed of about two (2) to about thirty (30) rotations per minute. The time necessary to effect complete mixing, or drying if the vessel is a tumble dryer, varies from application to application but typically requires from about five (5) to about sixty (60) minutes for a mixing application and about one (1) to about one hundred (100) hours in a drying application.

To enhance or accelerate the tumble mixing process, or where the processing vessel is a tumble dryer to de-lump any lumped powder, an agitator is rotated within the rotating vessel by means of a magnetic coupling between the agitator and a second motor or other power source located externally from the vessel. The magnetic coupling comprises, in one embodiment, a driving member fixedly attached to a shaft which is rotatably driven by the power source. The driving member comprises a circular arrangement of a plurality of magnets. The driving member is concentrically received within a pocket provided by a trunnion or drive housing projecting internally into the interior of the processing vessel. The drive housing is formed in a manner to be continuous with the wall of the vessel. The drive housing is further configured for close reception of the driving member within the pocket without physical connection therewith.

The driven member is comprised of a circular arrangement of a plurality of magnets. The driven member is fixedly attached to a shaft which itself is attached to a plurality of agitator blades. The circular arrangement of magnets comprising the driven member is, in one embodiment, of a larger diameter than the circular arrangement of magnets comprising the driving member. The driven member is concentrically received over the inwardly projecting drive housing of the vessel and thereby also concentrically over the driving member. The driven member is configured for close reception of the drive housing without physical connection therewith. The driven member is coupled to a shaft for transmitting rotational movement to an agitator and a plurality of agitator blades for enhancing the mixing of the powder or powders contained within the vessel.

In operation, the driving and driven members are disposed for magnetic coupling with each other whereby, upon rotating the driving member, the driven member correspondingly rotates. That is, rotation of the drive shaft and the driving member secured thereto tends to distort the lines of force passing from the driving member to the driven member and the driven member is thereby forced to follow the rotation of the driving member. The strength of the magnetic linkage of the driving and driven members is directly related to the density of the magnetic flux passing between them. In that regard, the drive housing must be constructed of a substantially non-magnetic material in order to permit the magnetic field between the driving member and the driven member to permeate therethrough. If necessary, the driving member is cooled and lubricated by a cooling bath inside the drive housing using mechanical seals, a small pump, a reservoir and a small heat exchanger.

The agitator blades rotate at a tip speed of about 1650 feet per minute to about 5000 feet per minute. Because of the work energy necessary to rotate the agitator and the agitator blades fixedly attached thereto through the powder within the mixing vessel, heat energy is created within the vessel. The heat energy can, in some mixing applications, increase the temperature of the air inside of the vessel. Temperatures inside of the vessel during agitator mixing operations can increase up to about 80° F. above the starting temperature in the vessel. In those mixing applications where a temperature rise occurs within the vessel, the air within the vessel expands, thus creating pressures in excess of the initial pressure inside of the vessel. Such pressure build-up inside the vessel during mixing of the powder with an agitator ranges from about two (2) pounds per square inch to about ten (10) pounds per square inch. Advantageously, this increase in pressure does not create the problems heretofore described. This is because in the present invention mechanical seals and/or packing have been eliminated from the vessel walls by using a magnetically coupled agitator. Thus, there is no possibility of failure of such seals and packing and hence there is no conduit for powders within the vessel to escape or become contaminated by the environment outside of the vessel. Similarly, because the need for atmospheric vents in the vessel have been eliminated by the present invention, there is no pathway for powders to escape from the vessel along this route. Additionally, because the need for mechanical seals and/or packing has been eliminated, the problem of batch to batch cross-contamination has also been resolved.

Once the powders within the vessel have been adequately mixed as determined by the time of mixing, the number of vessel rotations, the temperature within the vessel, or some other means, the power source for the agitator and then the power source for the rotating vessel are turned off, thus stopping the rotation of the agitator and the rotation of the vessel about its axis. Once the rotation of the agitator and vessel have halted, the vessel is oriented such that the main valve is at or near the bottom of the vessel and the cover is at or near the top of the vessel. Any build-up of pressure above the initial pressure within the vessel is then relieved either by opening the cover or by bleeding off the pressure prior to opening the cover by means of a relief valve attached to the cover or vessel wall. In either instance the pressure is exhausted to a contained dust collector system. If the pressure in the vessel is below atmospheric pressure, the pressure inside the vessel is equilibrated to atmospheric pressure by means of a process acceptable air source. This air source may be sterile.

Once any pressure within the vessel has been relieved, equalized and returned to atmospheric pressure levels, the main valve is opened and the mixed powders within the vessel are permitted to exit the vessel through the opened main valve to a subsequent processing step or into a container.

In the instance where the vessel operator chooses to load the powder into the processing vessel through the main valve instead of the cover, a mixing procedure similar to that hereinbefore described is followed except that the powder is loaded and then discharged, after mixing is complete, through the main valve.

It is to be understood that, in addition to the batch mixing process hereinbefore described, the mixing process may be also be operated in a continuous manner. That is, the powder or powders to be mixed may continuously be introduced into the rotating processing vessel while the magnetically coupled agitator is rotating, and the mixed powder or powders are also continuously withdrawn from the rotating processing vessel while the magnetically coupled agitator is rotating.

Further objects and advantages of the device and method of the present invention will be readily apparent to those skilled in the art and a better understanding of the present invention may be had by reference to the following detailed description taken in connection with the following drawings.

DETAILED DESCRIPTION OF THE PREFERRED EMBODIMENT

Figure 1:
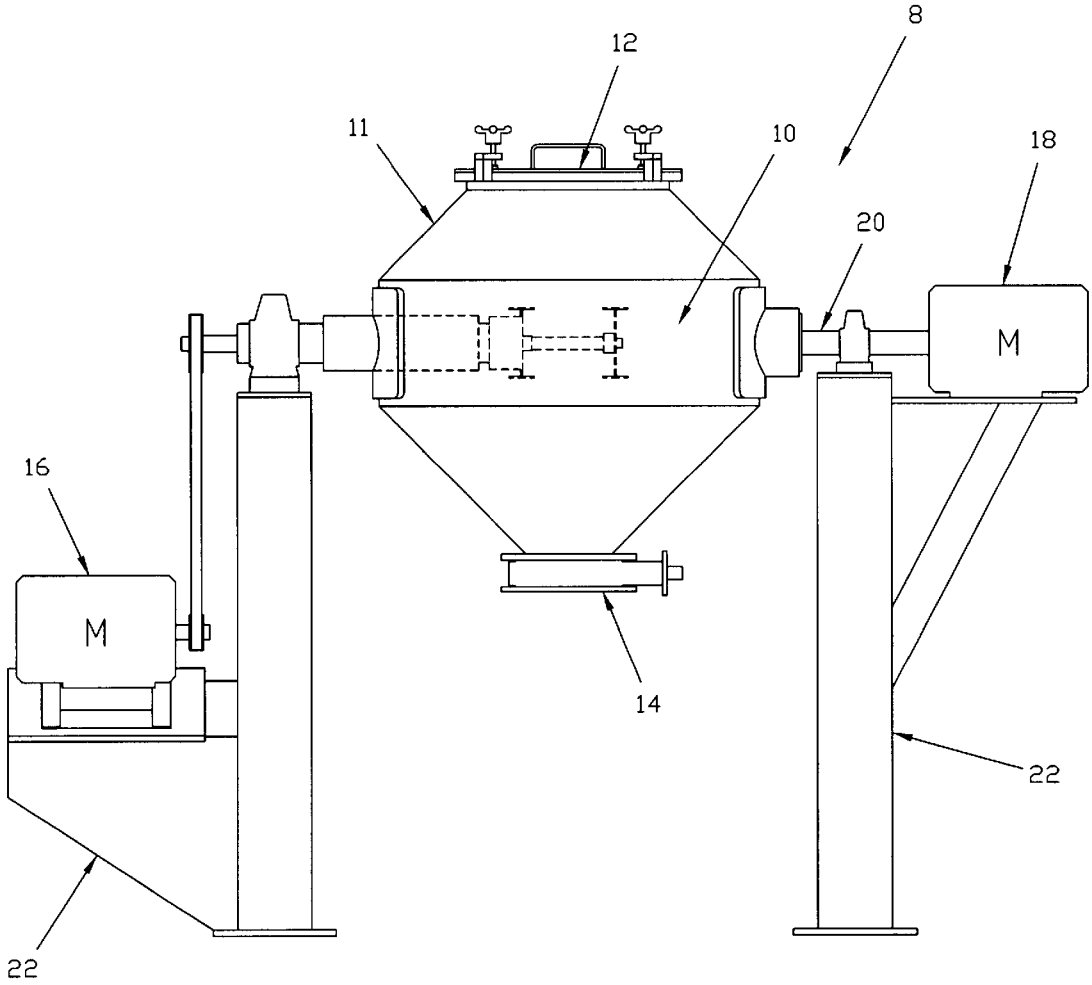
FIG. 1 is an illustration of a perspective view of a magnetically coupled agitator mounted on a tumble blender of the present invention.

Referring now to the drawings and more particularly to FIG. 1, there is shown a processing vessel, more particularly, a tumble blender 8. The shape of the blender is not pertinent to the present invention; however, the shape of the blender can be a slant cone, double cone, V-shaped or the like. A double cone blender is illustrated. The tumble blender 8 is comprised of either a single or multiple-walled shell 10 constructed of a substantially nonmagnetic material such as stainless steel. Mounted within the top wall 11 of the tumble blender 8 is a cover 12. The cover 12 is also constructed of a substantially non-magnetic material. After opening cover 12 and filling the tumble blender 8 with the powder or powders (not illustrated) to be mixed, the cover 12 is closed. The tumble blender 8 additionally comprises a main valve 14. In this embodiment the main valve 14 is not opened during the process of filling the tumble blender 8 with the powder or powders to be mixed.

After the filling procedure has been completed and the cover 12 is securely closed and main valve 14 remains securely closed, a motor 18 or other external power source is started. The motor 18 and gear reducer arrangement (not illustrated) is operated to engage a shaft 20 which is fixedly attached to tumble blender 8. In this manner the tumble blender 8 is rotated (tumbled) around its axis by means of motor 18 and shaft 20. Shaft 20 is supported by a pair of stanchions 22 resting on a floor or other horizontal surface. Stanchions 22 may either be permanently fixed to the floor or they may comprise wheels thus making the tumble blender 8 mobile.

Figure 2:
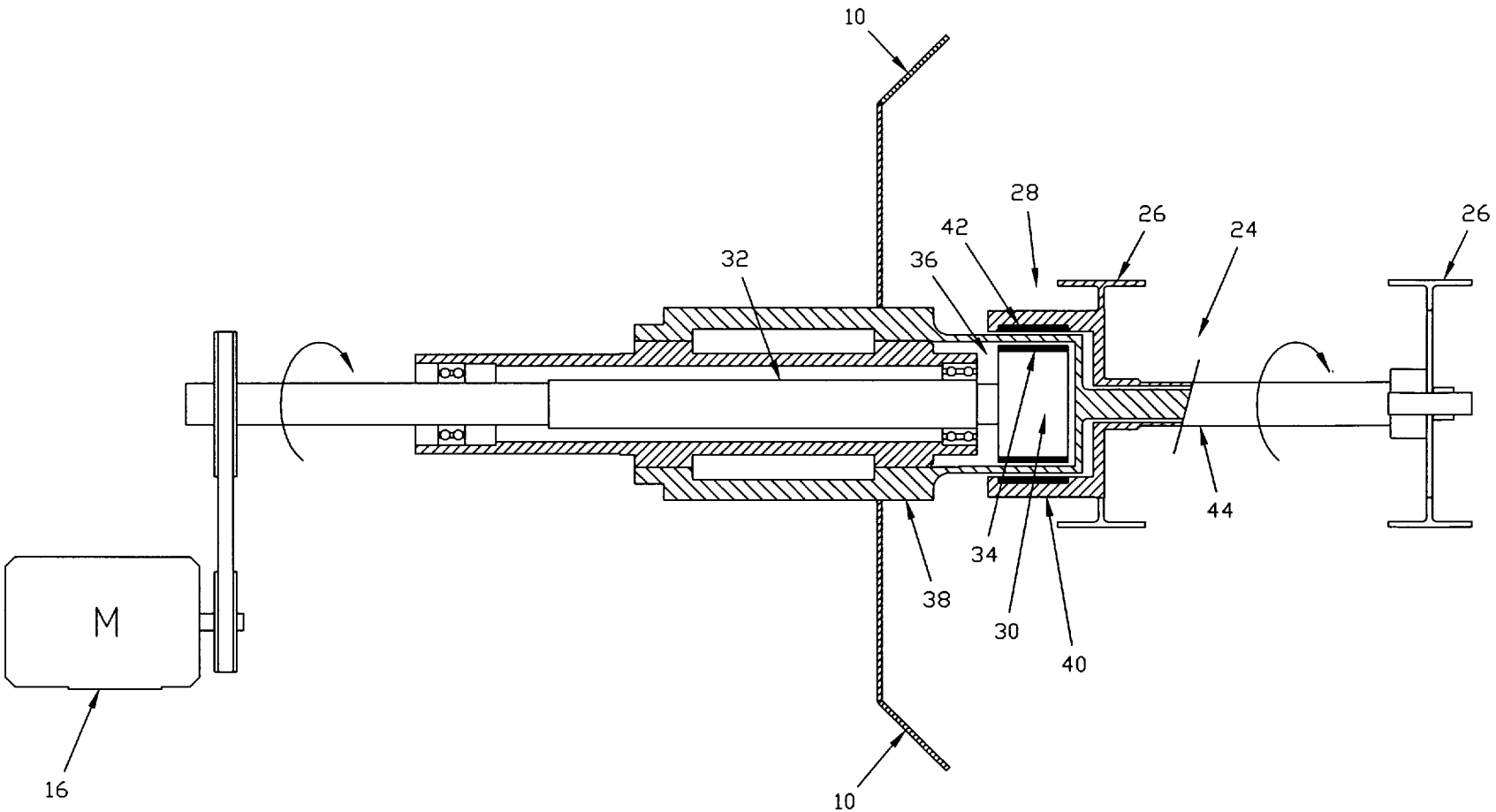
FIG. 2 is a longitudinal sectional view of one embodiment of the magnetically coupled agitator of FIG. 1.

Referring to FIG. 2, to enhance or accelerate the powder mixing process while the tumble blender 8 is rotating, an agitator 24 comprised of a plurality of agitator blades 26 of any shape, configuration or orientation is rotated within the rotating tumble blender 8 by means of a magnetic coupling 28 between the agitator 24 and a second motor 16 or other power source which has been started and which is located externally from the tumble blender vessel 10. The magnetic coupling 28 comprises a driving member 30 fixedly attached to a shaft 32 which is rotatably driven by motor 16. The driving member 30 comprises a circular arrangement of a plurality of magnets 34. In this embodiment the driving member 30 is concentrically received within pocket 36 provided by a drive housing 38 projecting internally into the interior of the tumble blender vessel 10.

Still referring to FIG. 2, a driven member 40 is comprised of a circular arrangement of a plurality of magnets 42 fixedly attached to a shaft 44 which itself is attached to agitator 24. In this embodiment the circular arrangement of magnets 42 of driven member 40 is of a larger diameter than the circular arrangement of magnets 34 of driving member 30. The driven member 40 is concentrically received over the inwardly projecting portion of drive housing 38 and thereby also concentrically over driving member 30.

Referring to FIGS. 1 and 2, the tumble blender 8 continues to rotate around its axis and agitator 24 continues to rotate inside of the rotating tumble blender 8 until the powder contained within tumble blender 8 has been adequately mixed in accordance with the standards or criteria established for a particular application. Upon mixing having been satisfactorily completed, motor 16 is turned off, thereby stopping the rotation of shaft 32, magnetic coupling 28, shaft 44 and agitator 24. Motor 18 is then turned off, thereby stopping the rotation of shaft 20 and the rotation of tumble blender 8. Once the rotation of the agitator 24 and tumble blender 8 have halted, the tumble blender 8 is oriented so that main valve 14 is in a position nearest the floor which supports stanchions 22. Any pressure above atmospheric within the tumble blender 8 which is present due to the work energy input into the tumble blender 8 by the rotation of the agitator 24 during the mixing process, is then relieved either by opening substantially airtight cover 12 or by opening a ball or similar type valve (not illustrated) integral with the shell 10 or cover 12 of the tumble blender 8. Once the pressure within tumble blender 8 has been reduced or equalized to atmospheric pressure, main valve 14 is opened and the mixed powders within tumble blender 8 exit the blender through main valve 14 to a subsequent processing step or into a container (not illustrated).

Alternatively, once the rotation of agitator 24 and tumble blender 8 have halted, tumble blender 8 can be oriented so that main valve 14 is above the level of the mixed powder. Any pressure within tumble blender 8 is then equalized to atmospheric pressure by opening main valve 14 or by opening a ball valve or similar type valve integral with the shell 10 or cover 14 of tumble blender 8. Once the pressure within tumble blender 8 has been equalized to atmospheric pressure, either cover 12 is opened and the mixed powders within tumble blender 8 exit the blender through cover 12, or main valve 14 is closed, tumble blender 8 rotated so that main valve 14 is near the floor, and main valve 14 then opened so the mixed powders within tumble blender 8 exit the blender through main valve 14.

Figure 3:
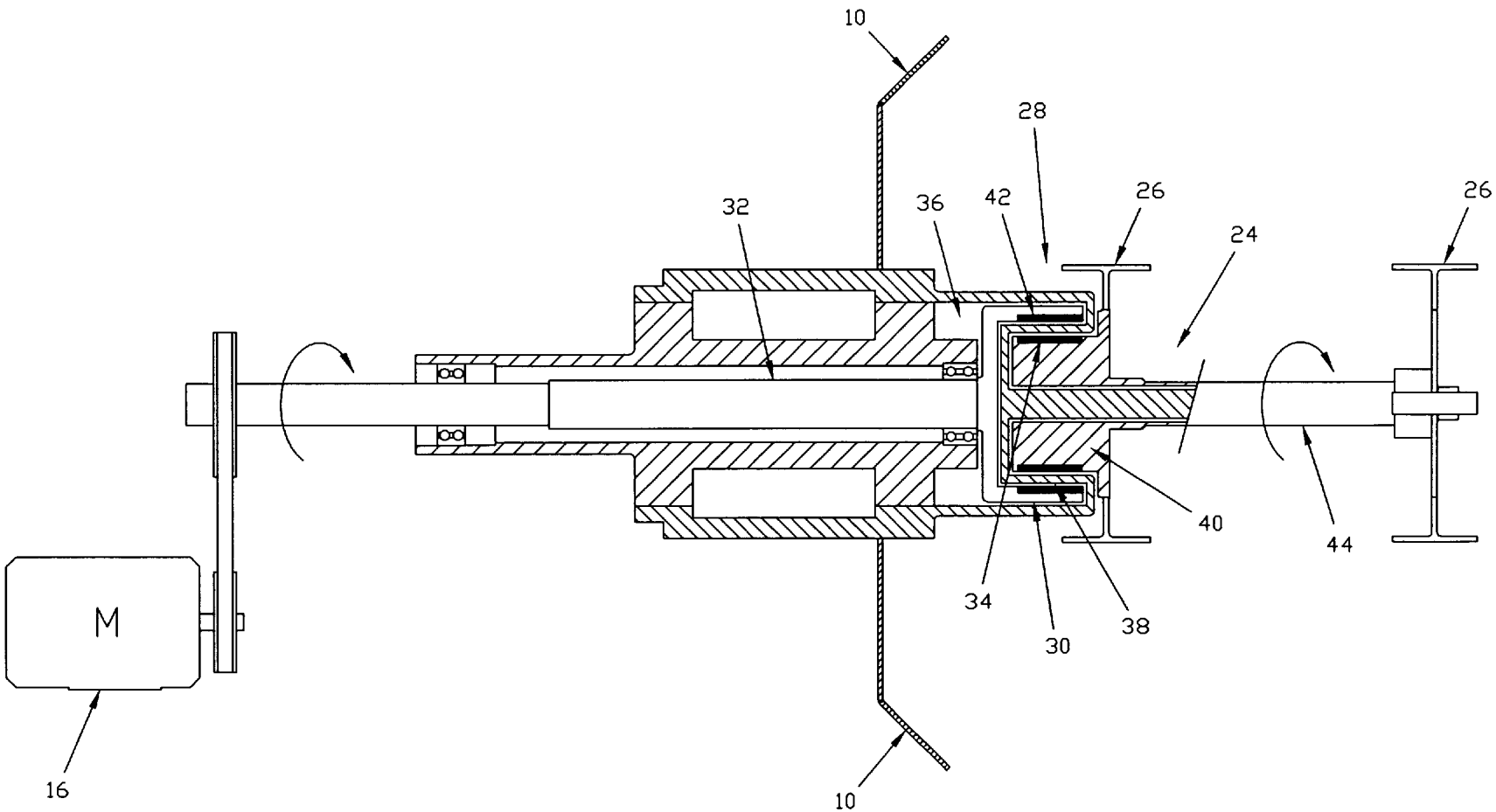
FIG. 3 is a longitudinal sectional view of a second embodiment of the magnetically coupled agitator of FIG. 1.

It is to be understood that the magnetic coupling 28 may take many different forms and no specific configuration is contemplated. For example, in another embodiment illustrated in FIG. 3 the driving member 30 is of a larger diameter than driven member 40. Here the driven member 40, which is fixedly attached to shaft 44 and which itself is fixedly attached to agitator 24, is concentrically received within pocket 36 provided by the drive housing 38. The driving member 30, which is fixedly attached to shaft 32 which is rotatably driven by motor 16, is concentrically received over drive housing 38 and thereby concentrically over driven member 40.

Figure 4:
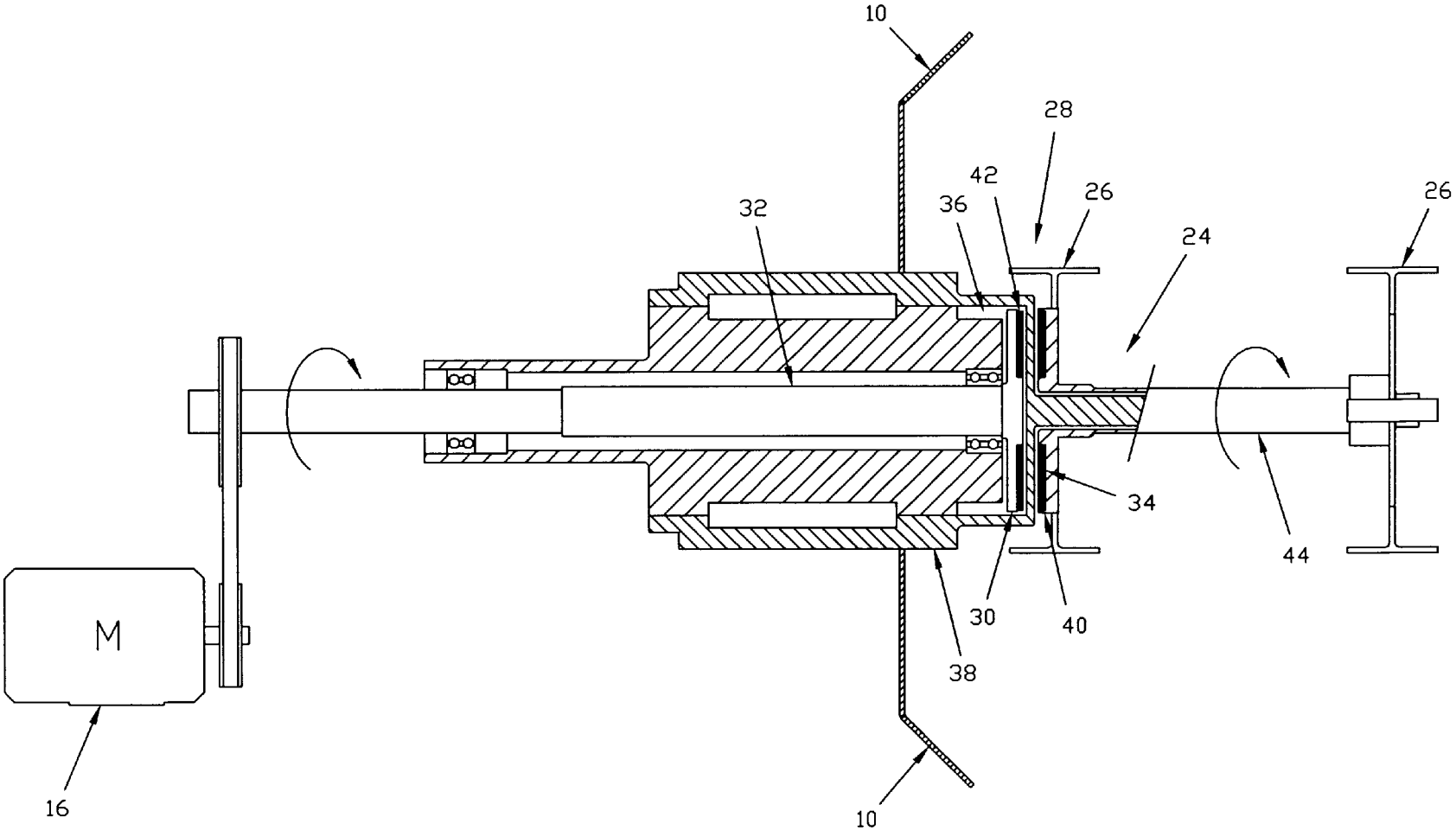
FIG. 4 is a longitudinal sectional view of a third embodiment of the magnetically coupled agitator of FIG. 1.
Figure 5:
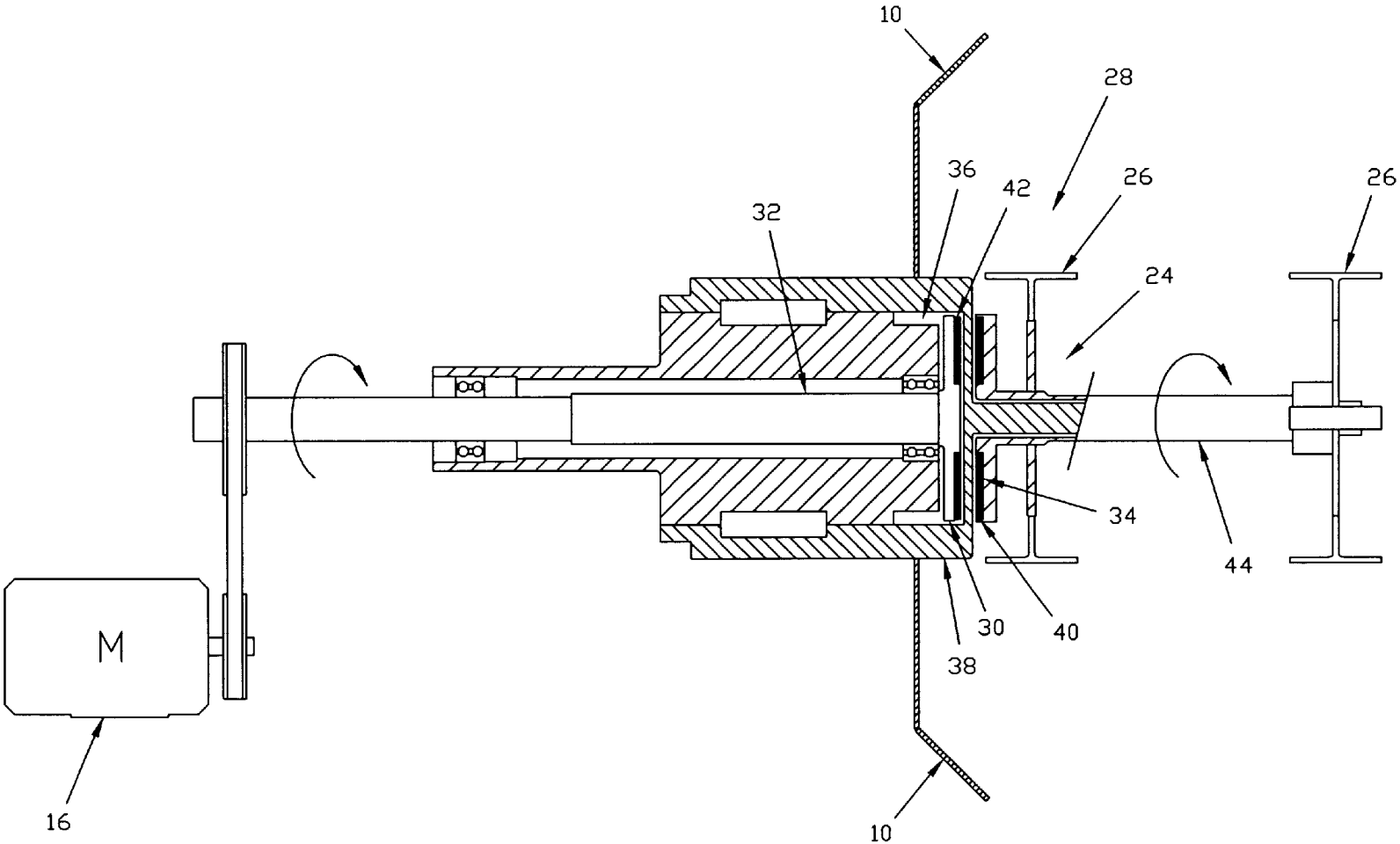
FIG. 5 is a longitudinal sectional view of a fourth embodiment of the magnetically coupled agitator of FIG. 1.

In yet two further embodiments of magnetic coupling 28 as illustrated in FIGS. 4 and 5, the driving member 30 and the driven member 40 are of substantially the same diameter.

In these embodiments the driving member 30 and the driven member 40 are axially aligned on opposite sides of drive housing 38.

Thus, it is seen that a rotating processing vessel and a method of using a magnetically coupled agitator to mix dry or moist powders inside of the rotating powder processing vessel has been provided which readily avoids the problems of seal and packing leakage and failure, blinding of atmospheric vent filter cloths, and cross-contamination associated with the use of agitators for mixing powders such as are known in the prior art. The preferred device and method of operation has been illustrated and described. Further modifications and improvements may be made thereto as may occur to those skilled in the art and all such changes as fall within the true spirit and scope of this invention are to be included within the scope of the claims to follow.

What is claimed is:

1. A method of mixing a powder, comprising:

providing a processing vessel constructed of a substantially non-magnetic material comprising a shell, a cover and a main valve, providing one or more powders to be mixed, opening said cover or said main valve, placing said one or more powders to be mixed within said processing vessel through said opened cover or said opened main valve, closing said opened cover or said opened main valve such that said processing vessel contains one or more powders to be mixed, rotating said processing vessel about its axis by means of a first power source located externally from said processing vessel, rotating an agitator within said rotating processing vessel by means of a magnetic coupling between said agitator and a second power source located externally from said rotating processing vessel, supplying heat to said powder within said rotating processing vessel by means of said rotating agitator within said processing vessel, increasing the pressure within said rotating processing vessel by means of said heat, rotating said processing vessel and said agitator within said rotating processing vessel until said one or more powders are mixed, shutting off said second power source and stopping the rotation of said agitator, shutting off said first power source and stopping the rotation of said processing vessel about its axis, relieving said pressure within said processing vessel, opening said main valve, and discharging the mixed one or more powders through said opened main valve.

2. A method of mixing a powder, comprising:

providing a substantially airtight processing vessel constructed of a substantially non-magnetic material comprising a shell, a cover and a main valve, providing one or more powders to be mixed, opening either said cover or said main valve, placing said one or more powders to be mixed within said processing vessel through said opened cover or said opened main valve, closing said opened cover or said opened main valve such that said processing vessel contains one or more powders to be mixed, sealing said cover and said main valve such that said processing vessel is substantially airtight, rotating said substantially airtight processing vessel about its axis by means of a first power source located externally from said processing vessel, rotating an agitator within said rotating processing vessel by means of a magnetic coupling between said agitator and a second power source located externally from said rotating processing vessel, supplying heat to said powder within said rotating processing vessel by means of said rotating agitator within said processing vessel, increasing the pressure within said rotating processing vessel by means of said heat, rotating said processing vessel and said agitator within said rotating processing vessel until said one or more powders are mixed, shutting off said second power source and stopping the rotation of said agitator, shutting off said first power source and stopping the rotation of said processing vessel about its axis, relieving said pressure within said processing vessel by opening said cover, opening said main valve, and discharging the mixed one or more powders through said opened main valve.

3. The method of claim 1 or claim 2 wherein said pressure increase within said processing vessel is from about 2 to about 10 pounds per square inch.

4. The method of claim 1 or claim 2 wherein said pressure within said processing vessel is relieved by means of opening said cover.

5. The method of claim 1 or claim 2 wherein said pressure within said processing vessel is relieved by means of opening a valve.

* * * * *